US010526172B2

(12) United States Patent
Meguro et al.

(10) Patent No.: US 10,526,172 B2
(45) Date of Patent: Jan. 7, 2020

(54) MECHANICAL HOISTWAY ACCESS CONTROL DEVICE

(71) Applicant: Otis Elevator Company, Farmington, CT (US)

(72) Inventors: Daisuke Meguro, Tokyo (JP); Hiromitsu Miyajima, Chiba (JP); Atsunori Kondo, Sakura (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 158 days.

(21) Appl. No.: 15/721,226

(22) Filed: Sep. 29, 2017

(65) Prior Publication Data

US 2019/0100411 A1 Apr. 4, 2019

(51) Int. Cl.
*B66B 13/16* (2006.01)
*B66B 5/00* (2006.01)

(52) U.S. Cl.
CPC ..... *B66B 13/16* (2013.01); *B66B 5/005* (2013.01)

(58) Field of Classification Search
CPC ..... B66B 5/005; B66B 5/0056; B66B 5/0062; B66B 13/16; B66B 13/20
See application file for complete search history.

(56) References Cited

U.S. PATENT DOCUMENTS 2,003,399 A 6/1935 Tamsitt
3,033,317 A 5/1962 Beck et al.
3,598,202 A 8/1971 Kirsch et al.
4,364,454 A * 12/1982 Glaser ..... B66B 13/20 187/314
4,418,795 A 12/1983 Trosky et al.
4,423,799 A 1/1984 Glaser et al.
5,669,465 A * 9/1997 Kulak ..... B66B 13/16 187/331
6,189,658 B1 2/2001 Karner
6,446,389 B1 * 9/2002 Heffner ..... B61D 19/02 49/280
6,508,332 B2 1/2003 Fahl et al.
(Continued)

FOREIGN PATENT DOCUMENTS

EP 0704402 A1 4/1996
EP 2426076 A1 3/2012
(Continued)

OTHER PUBLICATIONS

European Search Report for application 18196542.7, dated Mar. 1, 2019, 8 pages.

*Primary Examiner* — Minh Truong
(74) *Attorney, Agent, or Firm* — Cantor Colburn LLP

(57) ABSTRACT

A mechanical hoistway access control device for an elevator landing door includes a first blocking member mounted on a position on a landing door frame above a landing door, and a second blocking member mounted on a position on a car door frame above a car door. The first blocking member is pivotably attached between an upright position and a first horizontal position extending in the door opening direction about a horizontal shaft. The second blocking member is pivotably attached between an upright position and a second horizontal position about a horizontal shaft, the second horizontal position being where the second blocking member protrudes out to the landing door side to block movement of the first blocking member.

11 Claims, 8 Drawing Sheets

(56) References Cited

U.S. PATENT DOCUMENTS

| | | | | |
|---|---|---|---|---|
| 7,255,203 | B2 | 8/2007 | Rennetaud et al. | |
| 7,464,794 | B2 | 12/2008 | Badaoui et al. | |
| 7,607,517 | B2 | 10/2009 | Karner et al. | |
| 7,886,877 | B2 | 2/2011 | Ueda | |
| 8,602,171 | B2 | 12/2013 | Vogl | |
| 2015/0336770 | A1 | 11/2015 | Barneman | |
| 2019/0031468 | A1* | 1/2019 | Meguro | B66B 5/005 |

FOREIGN PATENT DOCUMENTS

| | | | |
|---|---|---|---|
| JP | 2010208739 | A | 9/2010 |
| WO | 2008078135 | A1 | 7/2008 |
| WO | 2013140575 | A1 | 9/2013 |

* cited by examiner

MECHANICAL HOISTWAY ACCESS CONTROL DEVICE

TECHNICAL FIELD

The present invention relates generally to a device for mechanically preventing engagement of an elevator landing door switch during elevator maintenance and inspection.

BACKGROUND ART

In general, an elevator landing door switch device for preventing intrusion of a person in a hoistway through a landing door is provided on each landing door. The landing door switch device, including an interlocking mechanism and a door switch, is configured to be released by mechanically interlocking with an elevator car door when the elevator car door is opened on arrival of the elevator car at a landing. When one of the landing door switch devices is released, operation of the elevator car is interrupted. Once the elevator door is closed, the landing door switch device is closed (i.e. the door switch is electrically connected) accordingly, and the elevator system resumes operation of the elevator car. With such configurations, not only can landing doors of an elevator be prevented from being opened improperly from the outside, but the operation of the elevator car can be interrupted appropriately when a landing door is opened on purpose or accidentally, thereby unforeseen accidents can be avoided in advance.

When a maintenance person enters a hoistway during maintenance and inspection of an elevator, a landing door switch device is released by unlocking its interlocking mechanism from the landing and opening the landing door manually, as known in the art. Therefore, the elevator car does not travel when the landing door is open.

However, in some elevators, the elevator car may resume operation once the landing door is completely closed during elevator maintenance, regardless of whether a maintenance person is in the hoistway. Further, even if the elevator has an inspection mode switch in addition to the landing door switch devices, there is always a chance that a maintenance person might forget to operate the safety switch, since the method of operating a safety switch differs depending on types of elevators.

Therefore, there exists in the art a need for providing a safety device of an elevator which can reliably stop operations of the elevator car at the time of elevator maintenance and inspection. There also exists in the art a need for providing a safety device for elevators capable of retrofitting for any type of elevators.

SUMMARY OF INVENTION

According to one aspect of the present invention, a mechanical hoistway access control device for an elevator landing door is disclosed. The mechanical hoistway access control device includes a first blocking member mounted on a position on a landing door frame above a landing door. The first blocking member is pivotably attached between an upright position and a first horizontal position extending in the door opening direction about a horizontal shaft. The mechanical hoistway access control device further includes a second blocking member mounted on a position on a car door frame above a car door. The second blocking member is pivotably attached between an upright position and a second horizontal position about a horizontal shaft, the second horizontal position being where the second blocking member protrudes out to the landing door side to block movement of the first blocking member. The first blocking member is configured to fall down in the first horizontal position to mechanically block complete closing of the landing door when the landing door is opened with no elevator car at the landing, and the second blocking member is configured to fall down in the second horizontal position before the first blocking member falls down to prevent the first blocking member from falling down in the first horizontal position when the landing door is opened in conjunction with the car door.

In some embodiments, the first blocking member is a latch including a tapered end and a cutout portion formed immediately behind the tapered end. The cutout portion is configured to engage with a corresponding receiver arranged on the upper edge of the landing door when the landing door is closed after the landing door is once opened with no elevator car at the landing. The engagement of the cutout portion with the receiver mechanically locks opening and closing of the landing door.

In some embodiments, the mechanical hoistway access control device further includes a landing door switch device that locks the landing door when the landing door is closed.

In some embodiments, the first blocking member has an L-shaped configuration including a first portion and a second portion. The first portion is pivotably attached between the upright position and the first horizontal position about the horizontal shaft arranged near the corner section of the L-shaped configuration. The second portion is configured such that it extends to the door opening direction from the corner section of the L-shaped configuration when the first portion is in the upright position, and configured to be in slidable contact with an upper edge of the landing door to maintain the first portion in the upright position when the landing door is closed.

In some embodiments, the second portion is configured to make slidable contact with the upper edge of the landing door to maintain the first portion in the upright position until the second blocking member falls down in the second horizontal position when the landing door is opened in conjunction with the car door.

In some embodiments, the mechanical hoistway access control device further includes a stopper mounted on a position on the car door around the upper edge so that the stopper makes contact with a landing door side surface of the second blocking member to maintain it in the upright position when the car door is closed.

In some embodiments, the stopper has a tapered portion oriented toward the door closing direction, the tapered portion configured to lift the second blocking member back into the upright position when the car door is closing.

In some embodiments, the second blocking member is formed of a cylindrical rod.

In some embodiments, the stopper is formed of a metal plate having a tapered shape oriented toward the door closing direction.

In some embodiments, the first blocking member further includes a biasing means for biasing the first blocking member in the upright position toward the first horizontal position.

In some embodiments, the second blocking member further includes a biasing means for biasing the first blocking member in the upright position toward the second horizontal position.

These and other aspects of this disclosure will become more readily apparent from the following description and the accompanying drawings, which can be briefly described as follows.

DESCRIPTION OF EMBODIMENTS

Figure 1:
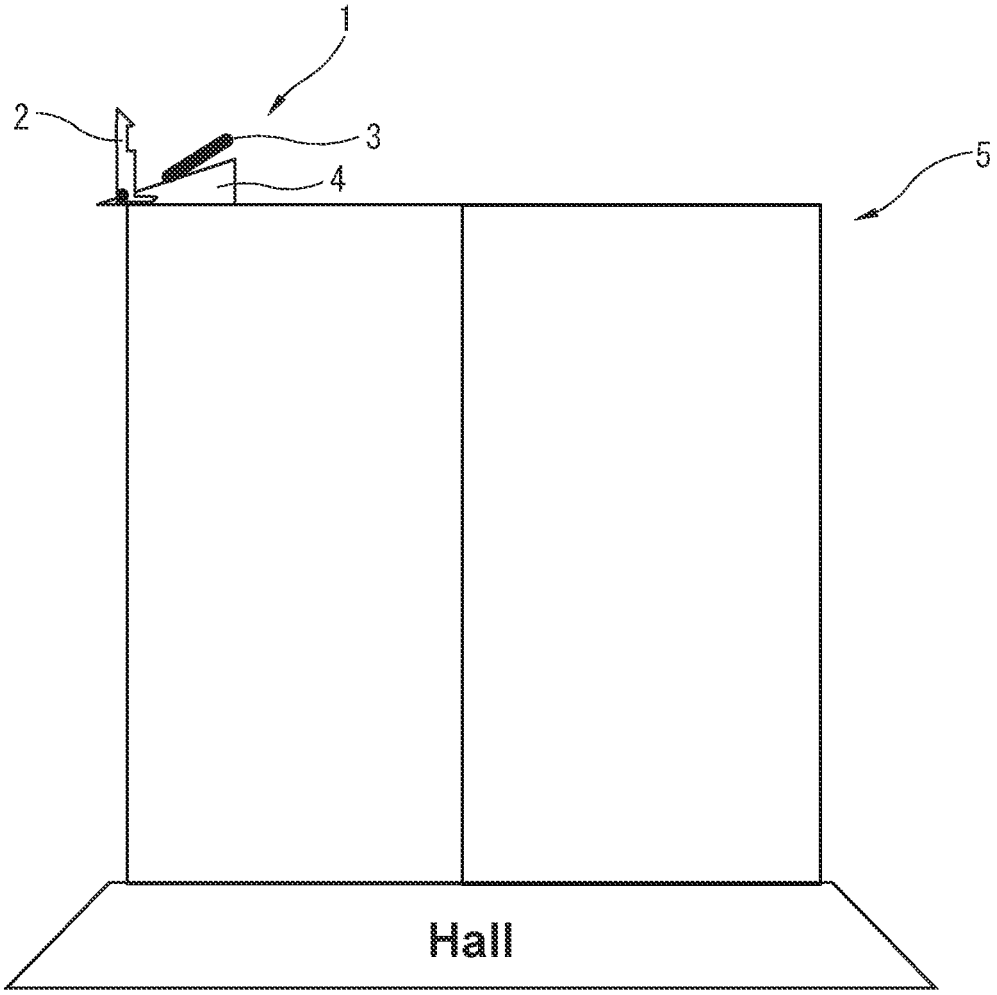
FIG. 1 is a schematic view showing one possible arrangement of a mechanical hoistway access control device (MHAD) in accordance with the present invention.

FIG. 1 is a schematic perspective view of a mechanical hoistway access control device (MHAD) 1 in accordance with the present invention including a latch 2, a latch prevention bar 3 and a stopper 4, which is viewed from a landing. A landing door 5 includes the latch 2, an elevator car (not shown) includes the latch prevention bar 3, and a car door (not shown) includes the stopper 4. As shown in FIG. 1, the latch 2 is mounted on a position above the door closing side end of the landing door 5. The latch prevention bar 3 is mounted on a position above the door closing side end of the elevator car door (not shown) so as to be arranged in proximity to the latch 2 at the landing. The stopper 4 arranged around the top portion of a car door panel (not shown) on the door closing side so as to be arranged in proximity to the latch prevention bar 3. Although the present invention will be described with reference to a landing door with a telescopic opening door, it is to be understood that the present invention may be installed on an elevator with central opening door.

Next, specific configurations of the MHAD 1 in accordance with the present invention will be described with reference to FIGS. 2A to 3B.

Figure 2A:
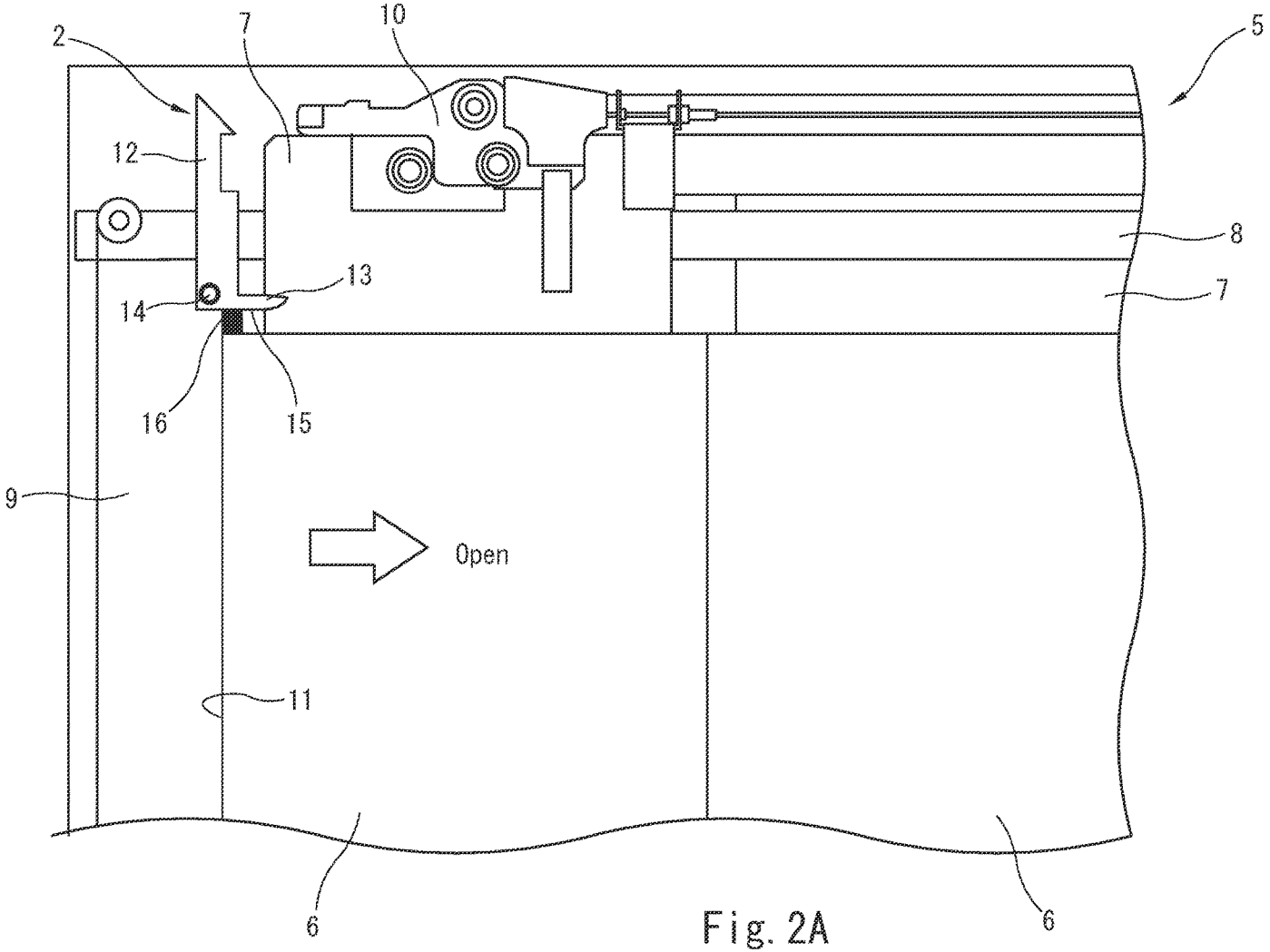
FIG. 2A is an enlarged view of a portion of a landing door including a latch mechanism in an upright position, when the landing door is closed.
Figure 2B:
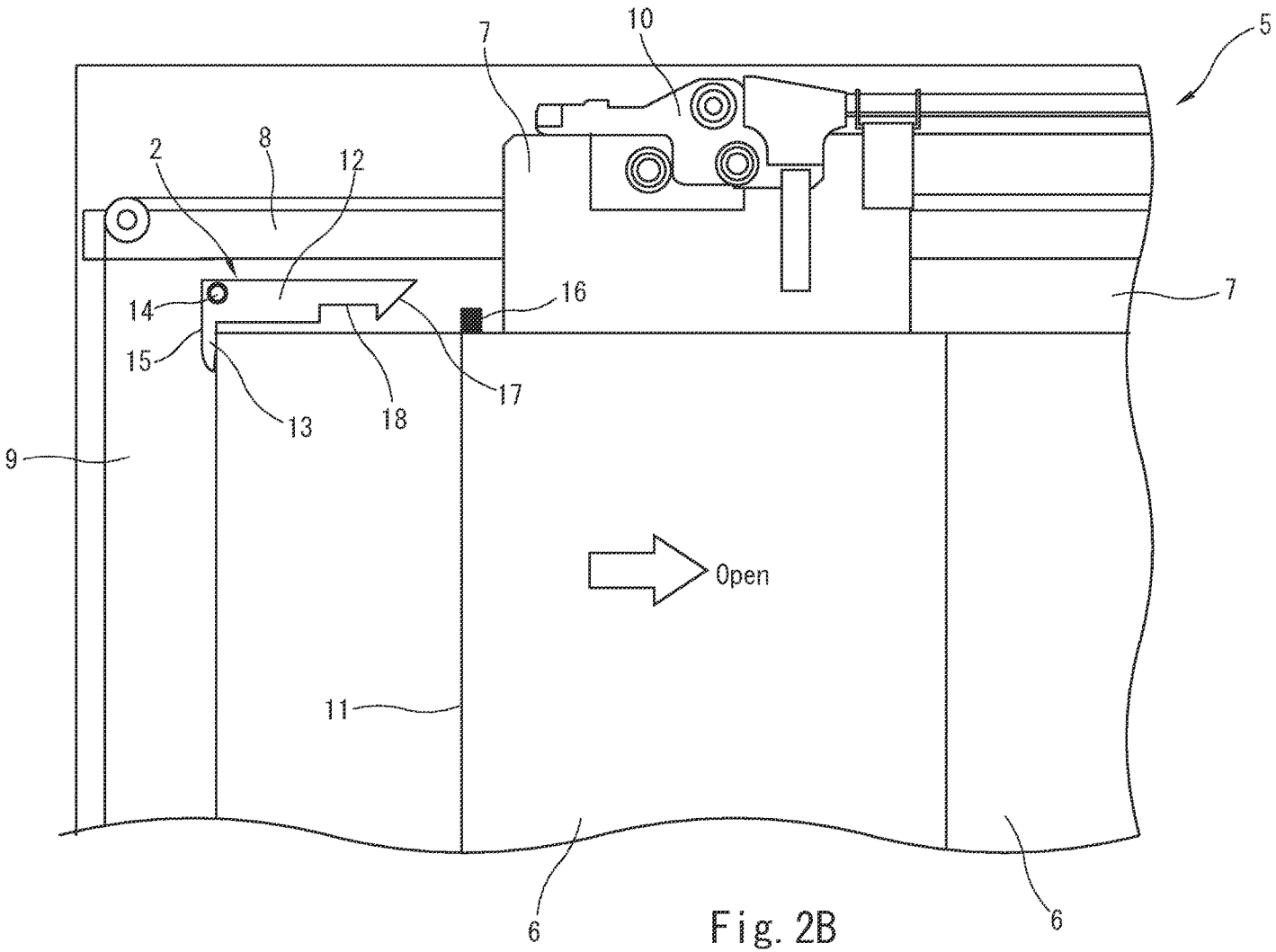
FIG. 2B is an enlarged view of a portion of a landing door including a latch mechanism in a horizontal position, when only the landing door is opened.

FIGS. 2A and 2B show a schematic perspective view of a portion of a landing door 5, which is viewed from a landing. The landing door 5 includes two door panels 6 and their respective door hangers 7 that are provided on the upper portion of the door panels 6 so as to support the door panels 6 on their respective door rails 8. When the landing door 5 is opened and closed, each door panel 6 slides to the right and left by means of a plurality of door rollers disposed within the corresponding door hanger 7 which move in the horizontal direction on the corresponding door rail 8. Two door rails 8 are fixed at the position on a door frame 9 on each floor of a building.

Each landing door 5 is generally provided with a landing door switch device 10. As shown in FIGS. 2A and 2B, the landing door switch device 10 is generally installed on the door hanger 7. As is well known, each landing door switch device 10 at each landing is electrically connected in series with each other with respect to an elevator control device, and the control device is configured to operate the elevator car only when the control device detects that all the landing door switch devices 10 are completely closed.

Furthermore, the latch 2 having a substantially L-shaped configuration is mounted on a predetermined position on the door frame 9 above the door closing side end 11 of the landing door 5. In particular, the latch 2 includes a first, longer portion 12 and a second, shorter portion 13. The first portion 12 is configured such that the first portion 12 is pivotably attached between an upright position (FIG. 2A) and a horizontal position (FIG. 2B) extending in the door opening direction about a horizontal shaft 14 arranged near the corner section of the L-shaped configuration. The second portion 13 is configured such that it extends to the door opening direction from the corner section of the L-shaped latch 2 when the first portion 12 is in the upright position. The bottom portion 15 of the second portion 13 is in slidable contact with the upper edge of the door panel 6 on the door closing side, or a corresponding latch receiver 16 of the latch 2 mounted on the upper edge of the door panel 6 when the landing door is closed. It should be understood that any type of the latch receiver 16 may be used as a corresponding latch receiver. In one example, as shown in FIGS. 2A and 2B, the latch receiver 16 may be attached on the upper edge of the door panel 6. In another example, the latch receiver 16 may be formed within the upper edge of the door panel 6 as a receiving recess. Alternatively, the latch receiver 16 may be formed by a door flange at the door closing side end 11 of the upper edge of the door panel 6.

As shown in FIG. 2A, the second portion 12 has a predetermined length and is in slidable contact with the receiver 16 (or the upper edge of the door panel 6), thereby holding the first portion 12 in the upright position while the receiver 16 is in contact with the bottom portion 15 of the second portion 13. In other words, the bottom portion 15 of the second portion 13 makes contact with the upper surface of the receiver 16 to prevent the first portion 12 from falling toward the horizontal position. When the landing door 5 opens and the latch receiver 16 is not in contact with the bottom portion 15 of the second portion 13, the first portion 12 falls down to the door opening side by its own weight and is maintained in the horizontal position, as shown in FIG. 2B. Optionally, the latch 2 may have a biasing means such as a spring mounted to bias the latch 2 in the upright position toward the horizontal position, so as to ensure that the first portion 12 falls down in the door opening direction to be set in a horizontal position when the landing door 5 is opened.

Referring to FIG. 2B, the first portion 12 of the latch 2 is arranged in the horizontal position. The first portion 12 includes a tapered end 17 and a cutout portion 18 formed in the lower portion of the first portion 12 (when viewed in FIG. 2B) immediately behind the tapered end 17. As will be described later, the cutout portion 18 is formed such that, when the landing door 5 is closed after the landing door 5 is once opened with no elevator car at the landing, the cutout portion 18 engages with the corresponding receiver 16 at the door closing side end of the upper edge of the landing door panel 6 on the door closing side.

Figure 3A:
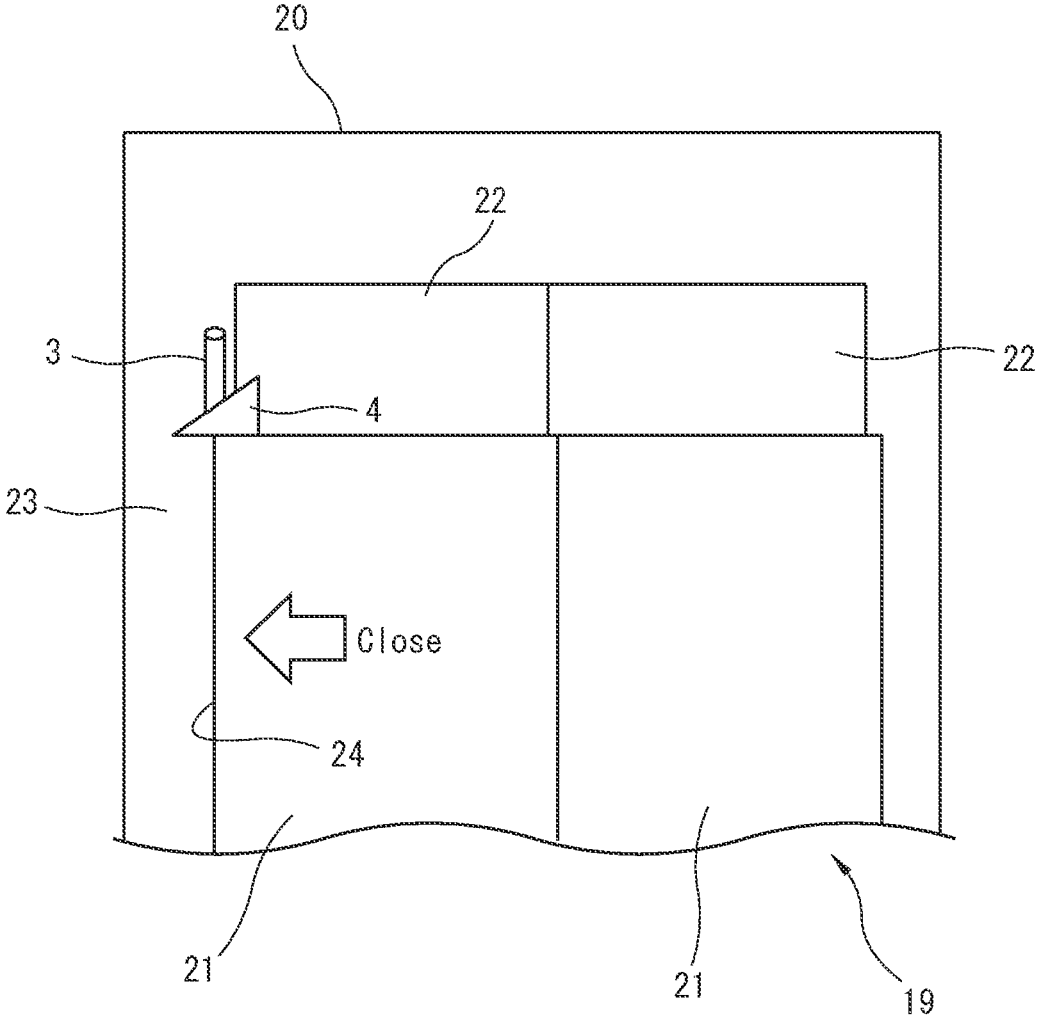
FIG. 3A is an enlarged view of a portion of an elevator car including a latch prevention mechanism in an upright position and an upright holding mechanism, when the car door is closed.
Figure 3B:
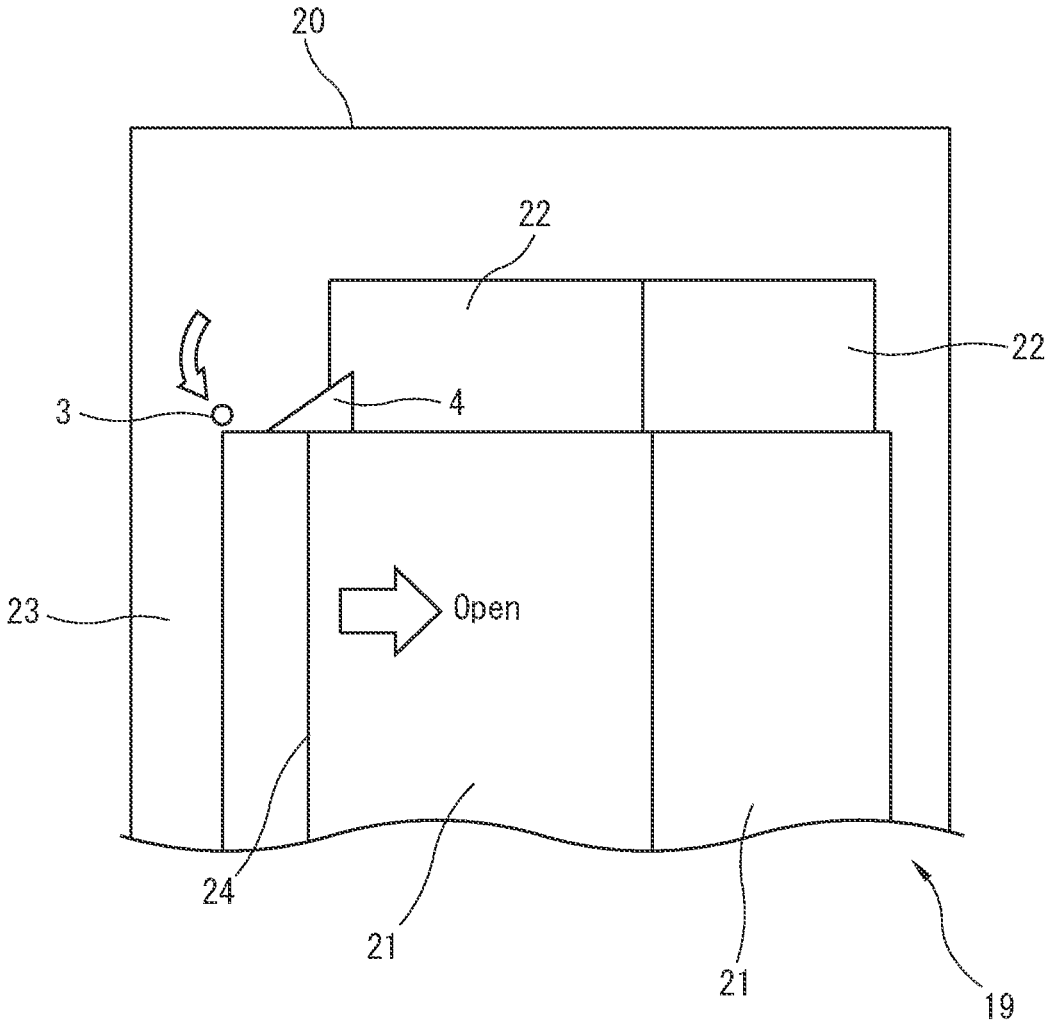
FIG. 3B is an enlarged view of a portion of an elevator car including a latch prevention mechanism in a horizontal position and an upright holding mechanism, during door opening operation.

FIGS. 3A and 3B show a portion of a car door 19 of the elevator car 20, which is viewed from a landing. Similarly to the landing door 5, the car door 19 also includes two door panels 21 and their respective door hangers 22 that are provided on the upper portion of the door panels 21 so as to support the door panels 21 on their respective door rails.

As shown in FIGS. 3A and 3B, a latch prevention bar 3 constituting the MHAD 1 of the present invention is mounted on a predetermined position on a car door frame 23 on the door closing side. In particular, the latch prevention bar 3 is arranged in a position on the car door frame 23 above the door closing side end 24 of the car door 19, so as to prevent the first portion 12 of the corresponding latch 2 from falling down in the horizontal position when the elevator car 20 stops at a landing and the car door 19 opens in conjunction with the landing door 5, as will be described later. In one example, the latch prevention bar 3 is formed of a generally cylindrical rod. The latch prevention bar 3 is pivotably attached between an upright position (FIG. 3A) and a horizontal position (FIG. 3B) extending to the landing door side about a horizontal shaft attached to the vertically lower end of the latch prevention bar 3. The horizontal shaft on the latch prevention bar 3 is arranged orthogonal to the horizontal shaft 14 on the latch 2.

Further, a stopper 4 constituting the MHAD 1 of the present invention is arranged in a position near the door closing side edge of the door hanger 22 in proximity to the latch prevention bar 3. Specifically, the stopper 4 is formed of a metal plate having a tapered shape oriented toward the door closing direction. The stopper 4 is attached to the door hanger 22 so that the stopper 4 makes contact with a landing door side surface of the latch prevention bar 3.

As shown in FIG. 3A, when the car door 19 is closed, the stopper 4 holds the latch prevention bar 3 in the upright position by preventing the latch prevention bar 3 from falling down in the horizontal position. On the other hand, as shown in FIG. 3B, when the car door 19 opens, the stopper 4 mounted on the door hanger 22 on the door closing side moves in the door opening direction and, thereby, the latch prevention bar 3 falls down and protrudes out to the landing door side (as shown by arrow) by its own weight to be set in the horizontal position. Optionally, the latch prevention bar 3 may have a biasing means such as a spring mounted to bias the latch prevention bar 3 in the upright position toward the horizontal position, so as to ensure that the latch prevention bar 3 falls down toward the landing door side to be set in a horizontal position when the car door 19 opens.

During closing operation, as the car door 19 moves in the door closing direction after the car door 19 is once opened, the tapered portion of the stopper 4 slides under the latch prevention bar 3 in the horizontal position to lift the latch prevention bar 3 back into the upright position as shown in FIG. 3A.

Although the latch prevention bar 3 is described as a cylindrical rod and the stopper 4 is described as a metal plate, it should be understood that the latch prevention bar 3 may be formed of any type of bar and the stopper 4 may have any desirable configuration or shape suitable for cooperating with the latch prevention bar 3. For example, the latch prevention bar 3 may be a rectangular solid having an engaging groove with its corresponding stopper 4 for easy lifting of the latch prevention bar 3.

The operation of the MHAD 1 in accordance with the present invention will now be described with reference to FIGS. 4A to 5G.

Figure 4A:
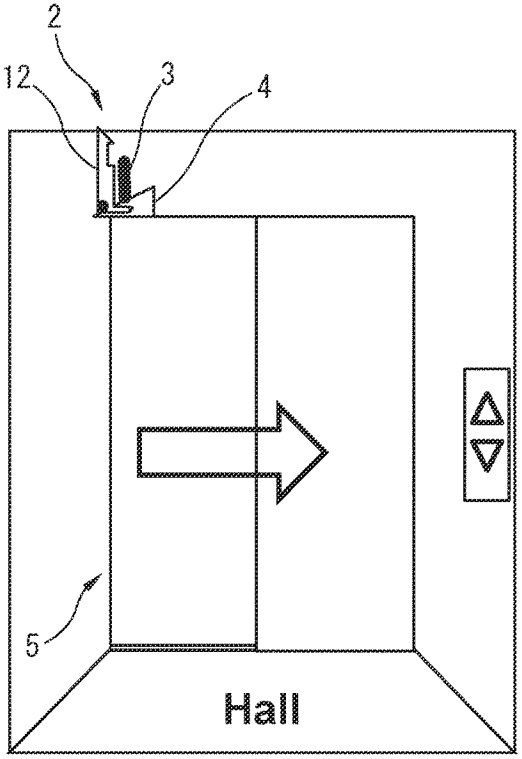
FIGS. 4A to 4C are schematic views showing various stages in the operation of the MHAD during normal operation of the elevator.
Figure 4B:
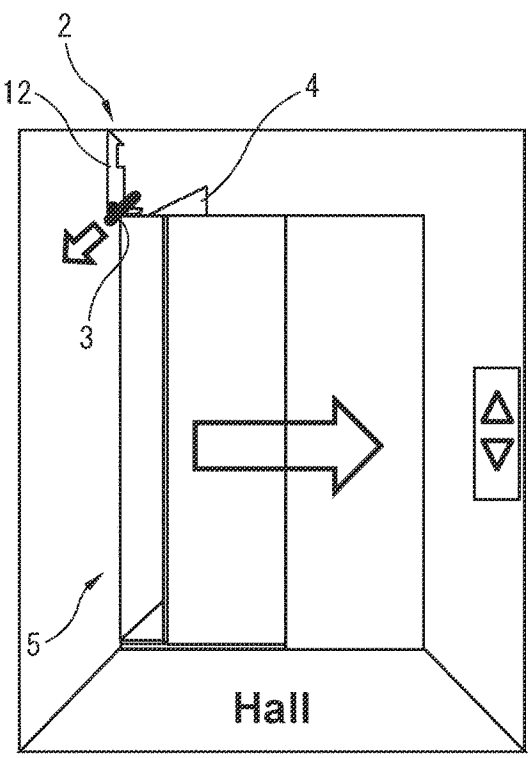
Figure 4C:
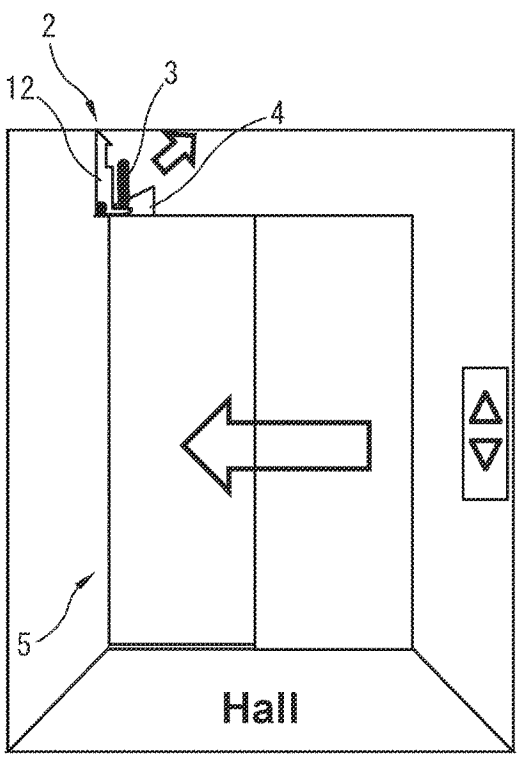

FIGS. 4A to 4C show a series of operations of the MHAD 1 during normal operation. As shown in FIG. 4A, when the elevator car 20 arrives at a landing, the first portion 12 of the latch 2 provided on the landing and the latch prevention bar 3 provided on the elevator car 20 are both maintained in the upright position.

When the landing door 5 slightly opens in response to the movement of the car door 19 in the door opening direction, the stopper 4 provided on the car door 19 for maintaining the latch prevention bar 3 in the upright position moves to the door opening direction and the latch prevention bar 3 falls down toward the landing door side. At this moment, since the second portion 13 of the latch 2 is still in slidable contact with the receiver 16 provided on the upper edge of the landing door 5, the first portion 12 of the latch 2 is held in the upright position.

When the landing door 5 further opens to a position where the latch receiver 16 is not in contact with the second portion 13 of the latch 2, the first portion 12 of the latch 2 falls down in the door opening direction and comes in contact with the latch prevention bar 3 positioned in the horizontal position. The first portion 12 is thereby prevented from falling down in the horizontal position.

During door closing operation, in response to the movement of the car door 19 in the door closing direction as shown in FIG. 4C, the tapered portion of the stopper 4 slides under the latch prevention bar 3 in the horizontal position to lift up the latch prevention bar 3 until it returns to the upright position. At the same time, since the receiver 16 (or the upper edge) of the landing door 5 comes in slidable contact with the second portion 13 of the latch 2 again, the landing door 5 is completely closed while maintaining the first portion 12 of the latch in the upright position. Even after the elevator car 20 has moved to another floor, the second portion 13 of the latch 2 is still held in contact with the receiver 16 on the landing door 5 and, therefore, the first portion 12 of the latch 2 is always kept in upright position during normal operation of the elevator.

Figures 5A, 5B, 5C, 5D, 5E, 5F, 5G:
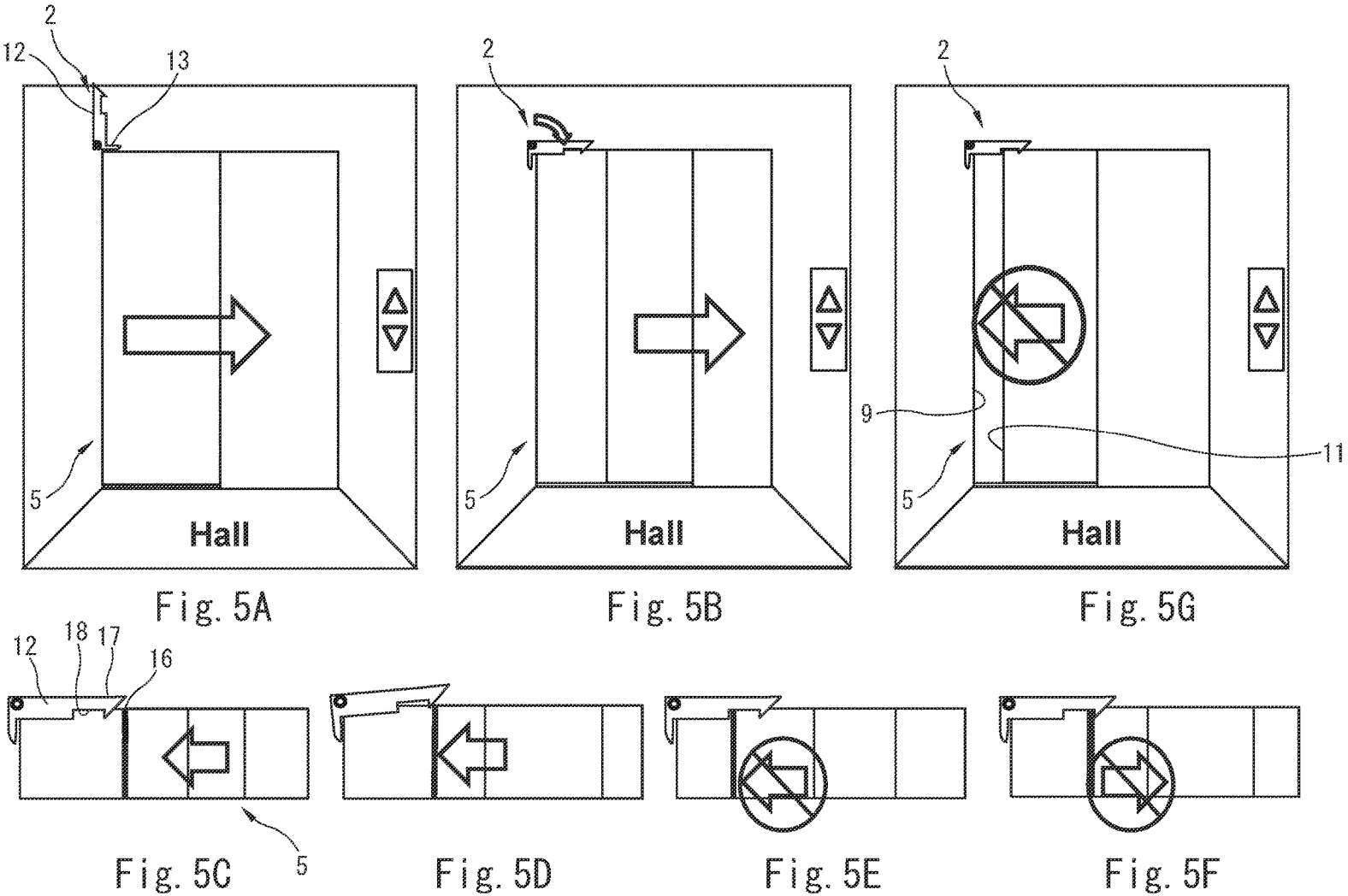
FIGS. 5A to 5G are schematic views showing various stages in the operation of the MHAD during elevator maintenance.

FIGS. 5A to 5G show a series of operations of the MHAD 1 of the present invention, when only the landing door 5 is opened during maintenance and inspection of an elevator. When a maintenance person enters a hoistway during maintenance and inspection of an elevator, the landing door 5 is opened manually by unlocking the interlocking mechanism of the door switch device 10 from the landing using a key, as known in the art. At this moment, the first portion 12 of the latch 2 is maintained in the upright position as shown in FIG. 5A. Then, as shown in FIG. 5B, when the landing door 5 is opened to a position where the receiver 16 is not in contact with the second portion 13 of the latch, the first portion 12 of the latch falls down in the door opening direction by its own weight or by biasing means to be set in the horizontal position.

Subsequently, as shown in FIG. 5C, when a maintenance person closes the landing door 5 from inside the hoistway during maintenance and inspection, the tapered end 17 of the first portion 12 of the latch 2 comes in contact with the latch receiver 16 at the corner on the door closing side end of the upper portion of the landing door 5. Then, as shown in FIG. 5D, as soon as the tapered end 17 runs on the latch receiver 16, the tapered end 17 drops downward by its own weight or by biasing means, and the cutout portion 18 engages with the latch receiver 16 as shown in FIG. 5E. Consequently, as shown in FIGS. 5E and 5F, the opening and closing of the landing door 5 is mechanically locked, leaving a slight gap between the door closing side end 11 of the landing door 5 and the landing door frame 9.

As shown in FIG. 5G, by mechanically locking the opening and/or closing of the landing door 5 leaving a slight gap between the landing door 5 and the door frame 9 during elevator maintenance and inspection, the engagement of the landing door switch device 10 is mechanically blocked. Thus, the MHAD 1 of the present invention can securely block operations of an elevator car during maintenance and inspection of the elevator system, regardless of the model of elevator installed. Moreover, as shown in FIG. 5F, since the door opening operation of the landing door 5 is also locked at the same time during elevator maintenance, the risk of a third person falling into the hoistway at the time of elevator maintenance can also be prevented. In particular, since the MHAD 1 of the present invention can mechanically block complete closing of the landing door 5 as shown in FIG. 5E, it ensures a temporary stop of the elevator car during maintenance and inspection of the elevator, even if a maintenance person has forgotten to activate a safety switch of the elevator.

The mechanical MHAD 1 of the present invention has a relatively compact, lightweight design applicable to almost all existing elevator systems. Furthermore, since the MHAD 1 of the present invention is configured to "mechanically" prevent the engagement of a landing door switch without using electrical equipment, any electrical control and complex wirings to hoistway is not required. Therefore, the MHAD 1 in accordance with the present invention can be retrofitted to almost all existing elevator systems.

In another embodiment of the present invention, the first portion 12 of the latch 2 may not include a tapered end 17 and a cutout portion 18. In this case, when the landing door 5 is closed after the landing door is once opened with no elevator car at the landing, the first portion 12 of the latch 2 does not engage with the corresponding latch receiver 16 on the landing door 5, but just comes in contact with the receiver 16. By utilizing the first portion 12 having no latching mechanism, a maintenance person can freely open and close the landing door 5 during maintenance and inspection of the elevator, while preventing the landing door 5 and thus the landing door switch device 10 from being completely closed.

Figure 6B:
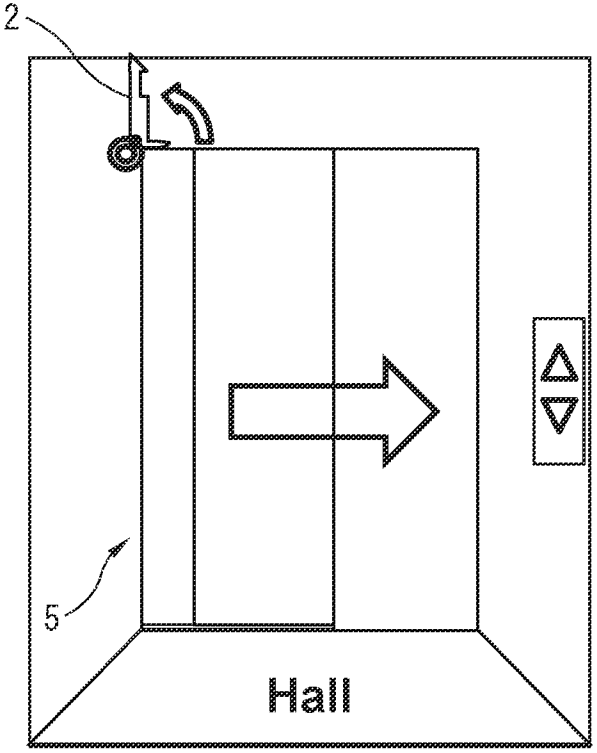
FIGS. 6A and 6B are schematic views showing a procedure for unlocking the MHAD.
Figure 6A:
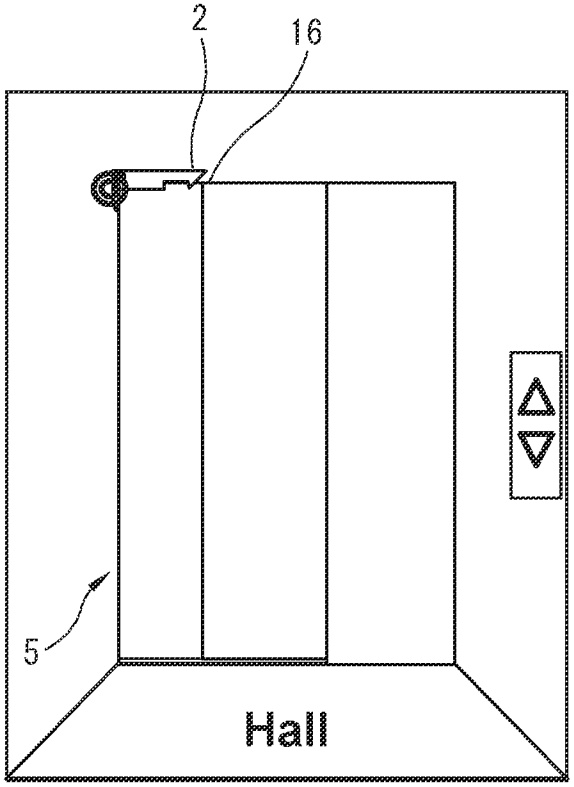

When unlocking or disengaging the latch 2 from the latch receiver 16, the latch 2 is turned from its latched position (i.e. the horizontal position) as shown in FIG. 6A to the unlatched position (i.e. the upright position) as shown in FIG. 6B, either from the inside or the outside of the hoistway manually or by using a corresponding key. Once the landing door 5 is completely closed manually from the outside of the hoistway after the maintenance and inspection of the elevator, the landing door switch device 10 is closed to enable normal operation of the elevator.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A mechanical hoistway access control device for an elevator landing door, comprising:

a first blocking member mounted on a position on a landing door frame above a landing door, the first blocking member pivotably attached between an upright position and a first horizontal position extending in the door opening direction about a horizontal shaft; and a second blocking member mounted on a position on a car door frame above a car door, the second blocking member pivotably attached between an upright position and a second horizontal position about a horizontal shaft, the second horizontal position being where the second blocking member protrudes out to the landing door side to block movement of the first blocking member, wherein the first blocking member is configured to fall down in the first horizontal position to mechanically block complete closing of the landing door when the landing door is opened with no elevator car at the landing, and wherein the second blocking member is configured to fall down in the second horizontal position before the first blocking member falls down to prevent the first blocking member from falling down in the first horizontal position when the landing door is opened in conjunction with the car door.

2. The mechanical hoistway access control device of claim 1, wherein the first blocking member is a latch including a tapered end and a cutout portion formed immediately behind the tapered end, wherein the cutout portion is configured to engage with a corresponding receiver arranged on an upper edge of the landing door when the landing door is closed after the landing door is once opened with no elevator car at the landing, and wherein the engagement of the cutout portion with the receiver mechanically locks opening and closing of the landing door.

3. The mechanical hoistway access control device of claim 1, further including a landing door switch device that locks the landing door when the landing door is closed.

4. The mechanical hoistway access control device of claim 1, wherein the first blocking member has a L-shaped configuration including a first portion and a second portion, the first portion pivotably attached between the upright position and the first horizontal position about the horizontal shaft arranged at a corner section of the L-shaped configuration, the second portion configured such that it extends to the door opening direction from the corner section of the L-shaped configuration when the first portion is in the upright position, and configured to be in slidable contact with an upper edge of the landing door to maintain the first portion in the upright position when the landing door is closed.

5. The mechanical hoistway access control device of claim 4, wherein the second portion is configured to make slidable contact with the upper edge of the landing door to maintain the first portion in the upright position until the second blocking member falls down in the second horizontal position when the landing door is opened in conjunction with the car door.

6. The mechanical hoistway access control device of claim 1, further including a stopper mounted on an upper edge of the car door so that the stopper makes contact with a landing door side surface of the second blocking member to maintain it in the upright position when the car door is closed.

7. The mechanical hoistway access control device of claim 6, wherein the stopper has a tapered portion oriented toward the door closing direction, the tapered portion configured to lift the second blocking member back into the upright position when the car door is closing.

8. The mechanical hoistway access control device of claim 1, wherein the second blocking member is formed of a cylindrical rod.

9. The mechanical hoistway access control device of claim 6, wherein the stopper is formed of a metal plate having a tapered shape oriented toward the door closing direction.

10. The mechanical hoistway access control device of claim 1, wherein the first blocking member further includes a biasing means for biasing the first blocking member in the upright position toward the first horizontal position.

11. The mechanical hoistway access control device of claim 1, wherein the second blocking member further includes a biasing means for biasing the first blocking member in the upright position toward the second horizontal position.

* * * * *